US009436132B2

(12) United States Patent
Furukawa

(10) Patent No.: US 9,436,132 B2
(45) Date of Patent: Sep. 6, 2016

(54) DEVELOPMENT DEVICE

(71) Applicant: CANON KABUSHIKI KAISHA, Tokyo (JP)

(72) Inventor: Mitsuhiro Furukawa, Chofu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/863,285

(22) Filed: Sep. 23, 2015

(65) Prior Publication Data

US 2016/0091830 A1 Mar. 31, 2016

(30) Foreign Application Priority Data

Sep. 26, 2014 (JP) ..... 2014-196671

(51) Int. Cl.
*G03G 15/09* (2006.01)

(52) U.S. Cl.
CPC ..... *G03G 15/0921* (2013.01)

(58) Field of Classification Search
CPC ..... G03G 15/0942; G03G 15/0921
See application file for complete search history.

(56) References Cited

U.S. PATENT DOCUMENTS

2007/0053725 A1* 3/2007 Sakamaki ..... G03G 15/0921 399/269
2010/0196045 A1* 8/2010 Kabashima ..... G03G 15/0921 399/104
2013/0051842 A1* 2/2013 Nose ..... G03G 15/0942 399/104

FOREIGN PATENT DOCUMENTS

JP 2007-72221 A 3/2007
JP 2007-72222 A 3/2007
JP 2008-116723 A 5/2008
JP 2010-061064 A 3/2010

* cited by examiner

*Primary Examiner* — Sandra Brase
(74) *Attorney, Agent, or Firm* — Canon U.S.A. Inc., IP Division

(57) ABSTRACT

A development device including a plurality of development sleeves and conducting development sleeve end portion seal using magnet members, a second magnetic pole and a third magnetic pole of a magnet incorporated in a second developer bearing member form repulsive poles. A position on the magnet member facing a rotation direction downstream end of the second developer bearing member is configured to be included in a zero Gauss zone. As a result, developer leak in the development sleeve rotation direction from between two development sleeves is suppressed.

6 Claims, 8 Drawing Sheets

DEVELOPMENT DEVICE

BACKGROUND OF THE INVENTION

1. Field of the Invention

The present invention relates to a development device used in image formation adopting an electro-photographic process or an electrostatic recording process.

2. Description of the Related Art

As the development device used to develop an electrostatic latent image formed on an image bearing member by the electro-photographic process or the electrostatic recording process, by a one-component developer or a two-component developer, a large number of development devices including a development sleeve have been conventionally discussed and adopted.

In general, the development sleeve is supported in an opening part via bearings at both end portions to be freely rotatable. The development sleeve has a surface subjected to surface roughing processing by using a blast or the like. Alternatively, the development sleeve has a surface on which a groove formed in a lengthwise direction is arranged regularly in a circumference direction. The surface of the development sleeve bears and conveys the developer. The latent image on the image bearing member is visualized by the borne developer.

In a case where the quantity of the developer on the surface of the development sleeve is non-uniform, the visualized image on a photosensitive drum also becomes non-uniform in concentration, resulting in a problem on the image. Therefore, it is desirable to make the quantity of the developer on the surface of the development sleeve, uniform. It is generally conducted to uniformly regular the quantity of the developer on the surface of the development sleeve by using a regulation member called regulation blade.

Furthermore, the development device includes a development container to accommodate the developer. In general, conveyance members, such as a screw, are disposed in the development container. The developer is circulated and conveyed in the development container by these conveyance members.

In recent years, speed increase has been promoted in such image forming devices using the electro-photographic process. In a case where the rotary moving speed of the photosensitive drum is comparatively low, a sufficiently favorable developed image is obtained even if the development time is short. Even if one development sleeve is used, therefore, a favorable image is obtained.

In a case where the rotary moving speed of the photosensitive drum is increased, however, a suitable image forming cannot be always conducted with one development sleeve. As a countermeasure, there is a method for improving the development efficiency by increasing the peripheral speed of the development sleeve. If the peripheral speed of the development sleeve is increased, however, centrifugal force acting upon the developer that forms a magnetic brush increases, and scattering of the developer increases. As a result, contamination within a copying machine is caused, and the function of the device might be lowered.

As a different countermeasure, therefore, a so-called multi-stage magnetic brush development method using two or more development sleeves is discussed (Japanese Patent Application Laid-Open No. 2007-72221). In the multi-stage magnetic brush development method, a plurality of development sleeves is disposed to be adjacent to each other with peripheral surfaces in close proximity to each other. The developer is conveyed continuously on peripheral surfaces to prolong the development time and enhance the development capability.

In such magnetic brush development having, for example, two development sleeves, however, there is a problem that the developer leaks out from between an upstream development sleeve and a downstream development sleeve at a development sleeve end portion into the rotation direction of the downstream development sleeve. Japanese Patent Application Laid-Open No. 2007-72222 takes a countermeasure against this problem. In each of end portions of the development sleeve in an axial direction, magnet members are disposed in close proximity in a non-contact state without being facing a delivery magnetic pole. Among the magnet members, at least a surface facing on the downstream side in the rotation direction of a downstream development sleeve is made the same polarity as a delivery magnetic pole of the downstream development sleeve. It is said that owing to such a configuration, leak of the developer from between the upstream development sleeve and the downstream development sleeve can be suppressed.

If the peripheral speed of the development sleeve is increased in accordance with the request for further increase of the speed, however, leak of the developer, which cannot be neglected, occurs from between two sleeves depending upon a position relation between a repulsion pole of the downstream development sleeve and the magnet member.

SUMMARY OF THE INVENTION

The present invention is directed to a development device including a plurality of development sleeves capable of suppressing leak of the developer in the rotation direction of the development sleeves from between two development sleeves while ensuring the magnetic seal property at the end portions of the development sleeves.

According to an aspect of the present invention, a development device includes a first developer bearing member configured to bear and convey a developer including magnetic particles and develop an electrostatic latent image, a second developer bearing member rotatable in a same direction as a rotation direction of the first developer bearing member and configured to bear and convey the developer delivered from the first developer bearing member and develop the electrostatic latent image developed by the first developer bearing member, a development container configured to expose portions of the first developer bearing member and the second developer bearing member in an opening portion and accommodate the developer, a first magnetic field generation member configured to be disposed within the first developer bearing member and include a plurality of magnetic poles including at least a first magnetic pole provided to face the second developer bearing member, a second magnetic field generation member configured to be disposed within the second developer bearing member and include a plurality of magnetic poles including a second magnetic pole and a third magnetic pole, the second magnetic pole being provided to substantially face the first magnetic pole and being different in polarity from the first magnetic pole, the third magnetic pole being same in polarity as the second magnetic pole and being disposed on an upstream side as compared with the second magnetic pole as regards the rotation direction of the second developer bearing member, a first magnet member provided in an end portion in an axis direction of the first developer bearing member and provided on a side opposite to an image bearing member, of the first developer bearing member, the first magnet member being provided on a downstream side as compared with the first magnetic pole as regards the rotation direction of the first developer bearing member, the first magnet member being disposed along a peripheral surface of the first developer bearing member, and a second magnet member provided in an end portion in an axis direction of the second developer bearing member and provided on a side opposite to the image bearing member, of the second developer bearing member, the second magnet member being provided on an upstream side as compared with the second magnetic pole as regards the rotation direction of the second developer bearing member, the second magnet member being disposed along a peripheral surface of the second developer bearing member, the second magnet member being disposed to face a zero Gauss zone, which becomes 50 Gauss or less in magnetic flux density, formed between the second magnetic pole and the third magnetic pole. As regards the rotation direction of the second developer bearing member, an upstream end of the second magnet member is disposed on an upstream side as compared with an upstream end of the zero Gauss zone, and a downstream end of the second magnet member is disposed on a downstream side as compared with the upstream end of the zero Gauss zone and on an upstream side as compared with a downstream end of the zero Gauss zone.

Further features of the present invention will become apparent from the following description of exemplary embodiments with reference to the attached drawings.

DESCRIPTION OF THE EMBODIMENTS

Hereafter, exemplary embodiments of a development device and an image forming device according to the present invention will be described with reference to the accompanying drawings. This development device is used in, for example, an image forming device described hereafter. However, the development device is not necessarily restricted to this form. As long as the device is an image forming device, therefore, the development device can be executed without a distinction of the number of photosensitive drums or a distinction of whether there is an intermediate transfer member. In addition, the development device can be executed without a distinction of the two-component developer/one-component developer. In the present exemplary embodiment, only a principal portion concerning forming of a toner image will be described. However, the present invention can be executed in various uses, such as printers, various printing machines, copying machines, FAX machines, and multifunction peripherals by adding necessary devices, equipment, and casing structures.

Figure 1:
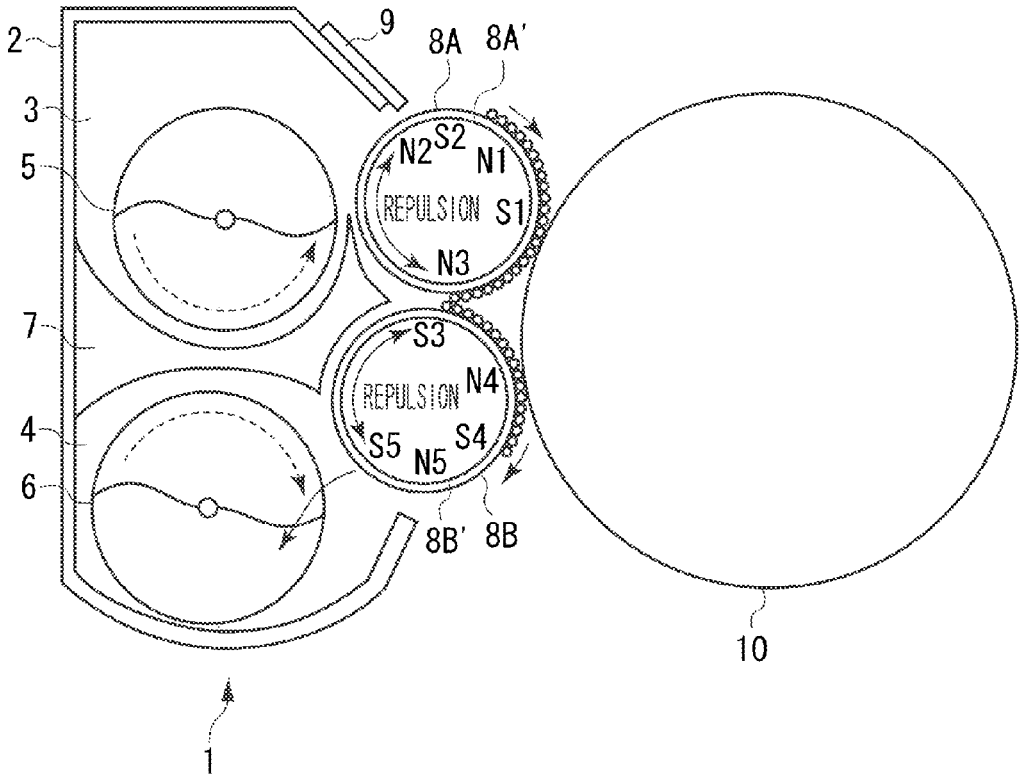
FIG. 1 is a sectional configuration diagram of a development device in which the present invention can be executed.

An exemplary embodiment 1 will now be described. FIG. 1 illustrates a position relation between an image bearing member (photosensitive drum) 10 and a development device 1 in each of stations Y, M, C and K in a full color image forming device. The stations Y, M, C and K have nearly the same configurations. The stations Y, M, C and K form images of yellow (Y), magenta (M), cyan (C) and black (K) in the full color image, respectively. In the ensuing description, for example, the development device 1 means a development device 1Y, a development device 1M, a development device 1C, and a development device 1K respectively in the stations Y, M, C and K, in common.

Figure 2:
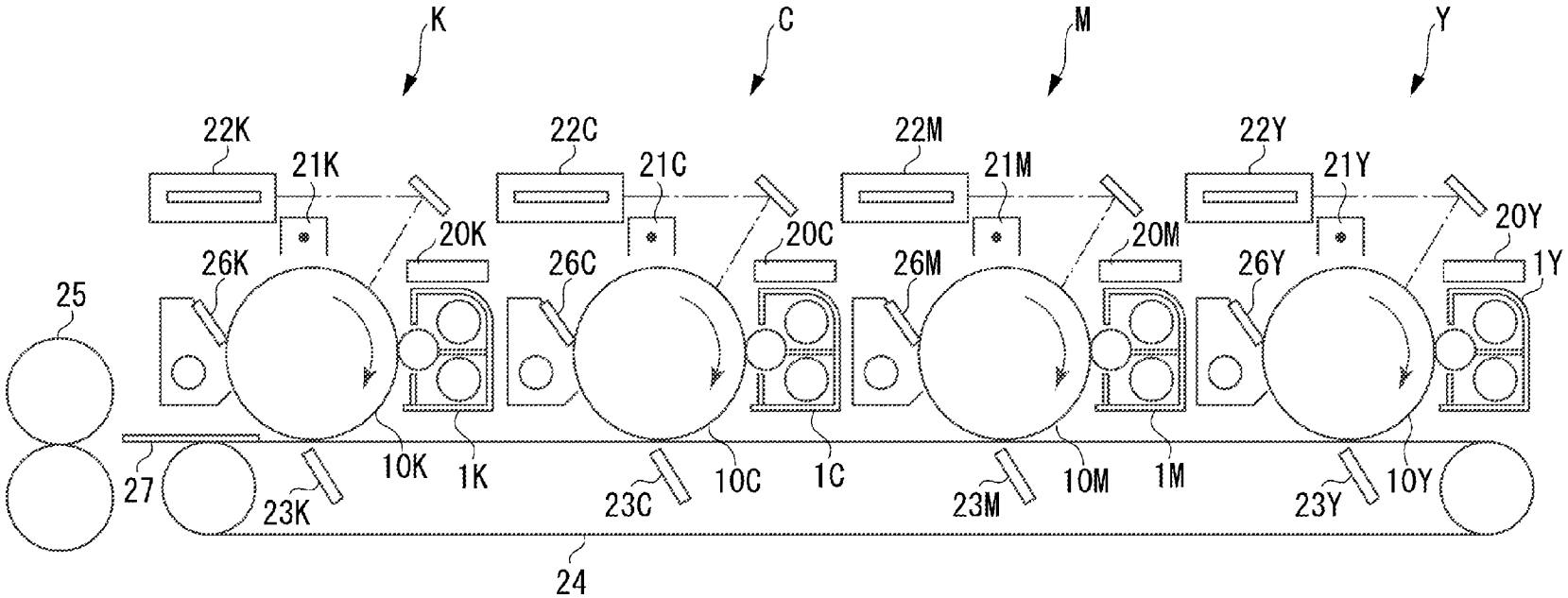
FIG. 2 is a schematic configuration diagram of an image forming device according to the present invention.

First, operation of the image forming device as a whole will now be described with reference to FIG. 2. The photosensitive drum 10, which is the image bearing member, is provided to be freely rotatable. The photosensitive drum 10 is charged uniformly by a primary charging device 21. The photosensitive drum 10 is exposed to light modulated in response to an information signal by a light emission element 22, such as, for example, a laser. As a result, a latent image is formed. The latent image is visualized as a developed image (toner image) by the development device 1 through a process described below. The toner image is transferred on a transfer sheet 27, which is a recording material conveyed by a transfer material conveying sheet 24, by a first transfer charging device 23 in each station. Then, the toner image is fixed by a fixing device 25, and a permanent image is obtained. Residual transfer toner on the photosensitive drum 10 is removed by a cleaning device 26. Toner in the developer consumed in the image forming is replenished from a tonner replenishing vessel 20. Here, a method for transferring the toner image directly onto the transfer sheet 27, which is the recording material conveyed from the photosensitive drums 10M, 10C, 10Y, and 10K by the transfer material conveying sheet 24, is taken. However, the present invention can also be applied to an image forming device configured to have an intermediate transfer member instead of the transfer material conveying sheet 24. In a configuration in this case, primary transfer of the toner images of respective colors from the photosensitive drums 10M, 10C, 10Y and 10K of respective colors onto an intermediate transfer member is conducted, and then secondary transfer of a complex toner image of respective colors onto a transfer sheet is collectively conducted. The process speed P of the image forming device is 500 mm/s.

(Description of Two-Component Developer)

The two-component developer used in the present exemplary embodiment will now be described.

The toner includes coloring resin particles and coloring particles. The coloring resin particles include a binding resin, a coloring agent, and other additives as occasion demands. The coloring particles are externally added with an external additive such as colloidal silica fine powders. The toner is polyester resin having a negative charging property. In the present exemplary embodiment, toner having a volume average particle diameter of 7.0 μm is used.

As for the carrier, metal such as, for example, surface oxidized or non-oxidized iron, nickel, cobalt, manganese, chrome, a rare earth, an alloy of them, or oxide ferrite can be suitably used. The manufacture method for these magnetic particles is not especially restricted.

(Development Device)

Operation of the development device 1 will now be described with reference to FIG. 1. An upstream development sleeve 8A is a first developer bearing member including a nonmagnetic material. In the upstream development sleeve 8A, a first magnet roller 8A' is fixed and disposed. The first magnet roller 8A' functions as a magnetic field generation unit (first magnetic field generation member) and takes a shape of a roller. The upstream development sleeve 8A has a diameter of Φ20 mm, rotates in a direction of an arrow at peripheral speed of 750 mm/s, and bears and conveys the developer. A regulation blade 9 is disposed over the upstream development sleeve 8A. A magnetic pole N2 is disposed in the first magnet roller 8A'near the regulation blade 9. The developer restrained and accumulated by magnetic force of the magnetic pole N2 is regulated to a proper developer layer thickness by the regulation blade 9. Then, the developer is borne and conveyed to a first development region. The first magnet roller 8A' includes a development magnetic pole S1 facing the first development region. A magnetic brush of the developer is formed by a development magnetic field formed in the first development region by the development magnetic pole S1. The magnetic brush comes in contact with the photosensitive drum 10 rotating in the first development region, and develops the electrostatic latent image in the first development region. At that time, toner sticking to the magnetic brush and toner sticking to the surface of the development sleeve also transfer to an image region of the electrostatic latent image and the electrostatic latent image is developed. In the present exemplary embodiment, the first magnet roller 8A' includes N1, N3 and S2 poles besides the magnetic poles S1 and N2. Among them, the N2 pole and the N3 pole are the same polarity and are adjacent to each other. Since a repulsive magnetic field is formed, a barrier is formed to the developer.

A downstream development sleeve 8B is disposed in a region nearly facing both a lower portion of the upstream development sleeve 8A and the photosensitive drum 10. The downstream development sleeve 8B is a second developer bearing unit. The downstream development sleeve 8B has a diameter of Φ20 mm, and is rotatable in a direction of an arrow (in the same direction as the upstream development sleeve) at a peripheral speed of 750 mm/s. The downstream development sleeve 8B is formed of a non-magnetic material in the same way as the upstream development sleeve 8A. A second magnet roller 8B' is disposed in a non-rotating state within the downstream development sleeve 8B. The second magnet roller 8B' functions as a magnetic field generation unit (a second magnetic field generation member) and takes a roller shape. The second magnet roller 8B' has five magnetic poles S3, N4, S4, N5, and S5. Among them, a magnetic brush on the N4 pole is in contact with the photosensitive drum 10 in a second development region. The magnetic brush on the N4 pole conducts development of a second time on the photosensitive member that has passed through the first development region. The S3 pole and the S5 pole are the same polarity. A repulsive magnetic field is formed between the S3 pole and the S5 pole. A barrier is formed to the developer between the S3 pole and the S5 pole. Among them, the S3 pole faces the N3 pole of the first magnet roller 8A' incorporated in the upstream development sleeve 8A in a vicinity of a position where both sleeves lie in closest proximity to each other.

The repulsive magnetic field is formed between the N3 pole and the N2 pole of the first development sleeve 8A. The repulsive magnetic field is also formed between the S3 pole and the S5 pole of the second development sleeve 8B. Therefore, the developer that has been conveyed on the first development sleeve 8A and has passed through the development region reaches the N3 pole. The developer cannot path through the position where both sleeves lie in closest proximity due to the repulsive magnetic field. In the present exemplary embodiment, the N3 pole functioning as a first magnetic pole is provided within the first development sleeve 8A in a position facing the second development sleeve 8B. In addition, the S3 pole is disposed within the second development sleeve 8B in a position facing the first magnetic pole. The S3 pole functions as a second magnetic pole, which is different in polarity from the first magnetic pole.

The developer moves to the downstream development sleeve 8B side according to a magnetic force line extending from the N3 pole to the S3 pole direction and conveyed on the downstream development sleeve 8B as far as a conveying screw 6 in an agitation chamber 4 as illustrated in FIG. 1. The N3 pole, which is the first magnetic pole, functions as a delivery pole and delivers the developer from the first development sleeve 8A to the second development sleeve 8B. The S3 pole is the second magnetic pole. The S3 pole functions as a reception pole, which receives the developer from the first development sleeve 8A to the second development sleeve 8B. By providing the downstream development sleeve 8B under the upstream development sleeve 8A as in the present exemplary embodiment, the developer is conveyed on the upstream development sleeve 8A as represented by N2→S2→N1→S1→N3. Then, the developer on the upstream development sleeve 8A is blocked by a repulsive magnetic field between both sleeves. The developer moves onto the downstream development sleeve 8B and conveyed on the downstream development sleeve 8B as represented by S3→N4→S4→N5→S5. Then, the developer is blocked at the S5 pole by a repulsive magnetic field, and peeled down into the agitation chamber 4.

It is not necessary that the delivery pole N3 and the reception pole S3 face each other completely. If the delivery pole N3 and the reception pole S3 nearly face each other within a range of a deviation of 45° from the perfect facing state, it is possible to conduct delivery and receipt of the developer smoothly.

A nearly central portion within the development container 2 is divided vertically into a development chamber 3 and the agitation chamber 4 by a partition wall 7, which extends in a direction perpendicular to the paper. The developer is accommodated into the development chamber and the agitation chamber 4. An opening portion is provided in a development container 2. A portion of the first development sleeve 8A and the second development sleeve 8B is configured to be exposed from the opening portion.

A first conveying screw 5 and a second conveying screw 6 are disposed in the development chamber 3 and the agitation chamber 4, respectively. The first and second conveying screws 5 and 6 are circulation units, which agitate and convey the developer and circulate the developer in the development container 2. The first conveying screw 5 is disposed in a bottom portion of the development chamber 3 substantially in parallel to an axis direction of the development sleeve 8A. The first conveying screw 5 rotates and conveys the developer in the development chamber 3 in one direction along the axis line direction. The second conveying screw 6 is disposed in a bottom portion in the agitation chamber 4 substantially in parallel to the first conveying screw 5. The second conveying screw 6 conveys the developer in the agitation chamber 4 in a direction opposite to that of the first conveying screw 5. In this way, the developer conveyed by the rotation of the first and second conveying screws 5 and 6 is circulated between the development chamber 3 and the agitation chamber 4 through opening portions (communicating portions) in both end portions of the partition wall 7. The developer in the first conveying screw portion is supplied from an opening portion between the regulation blade 9 and the partition wall 7 by drive of the first conveying screw 5. Each of the first and second conveying screws 5 and 6 has a screw structure formed by providing an agitation wing formed of a non-magnetic material around a rotation axis, in a spiral form. Each of all screw diameters is Φ30 mm, the screw pitch is 30 mm, and the number of rotations is set to 800 rpm.

Both the toner and the carrier of the developer pass through between a tip portion of the regulation blade 9 and the upstream development sleeve 8A, and are sent to the development region. An ear-cutting quantity of the developer magnetic brush borne on the upstream development sleeve 8A is regulated and the quantity of the developer conveyed to the development region is adjusted by adjusting a gap between the regulation blade 9 and a surface of the upstream development sleeve 8A. In the present exemplary embodiment, the developer coat quantity per unit area on the upstream development sleeve 8A is regulated to 30 mg/cm$^2$ by the regulation blade 9. The developer coat quantity of the downstream development sleeve 8B becomes approximately 30 mg/cm$^2$, because the developer is delivered from the upstream development sleeve 8A. The developer coat quantity of the upstream and downstream development sleeves is preferably in a range of approximately 30±10 mg/cm$^2$ through the durability period.

(End Portion Configuration)

Figure 3:
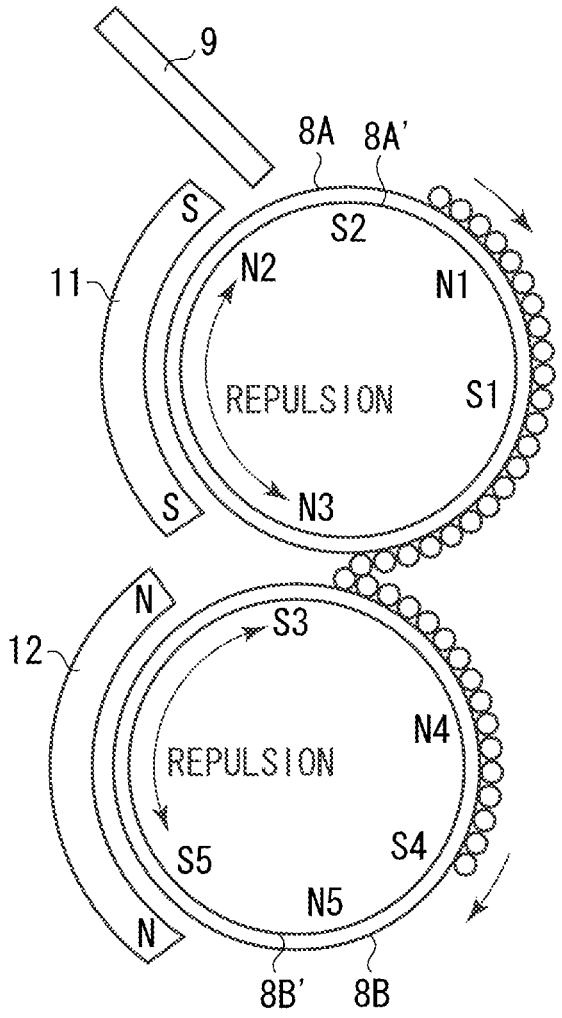
FIG. 3 is a diagram illustrating a position relation between a development sleeve and an incorporated magnet, and a magnetic seal member in an exemplary embodiment 1 according to the present invention.

A magnetic seal portion in the present exemplary embodiment will be described in detail with reference to FIG. 3. As illustrated in FIG. 3, plate-like magnets (magnet plates) 11 and 12 are provided in end portions in an axis direction of the upstream and downstream development sleeves 8A and 8B. The plate-like magnets (magnet plates) 11 and 12 are provided on a side opposite to the side where the photosensitive drum 10 is disposed. The plate-like magnets (magnet plates) 11 and 12 are provided along and in close proximity to the upstream and downstream development sleeves 8A and 8B without being in contact with the upstream and downstream development sleeves 8A and 8B. The plate-like magnets (magnet plates) 11 and 12 are magnet members and are disposed as magnetic seal members. Owing to this configuration, a magnetic ear is formed of the developer between the magnet rollers 8A' and 8B' respectively in the development sleeves 8A and 8B and the magnets 11 and 12, which are magnetic seal members. As a result, leak of the developer can be prevented. In the magnet plates used here, a first surface of each of the magnetic seal members 11 and 12 is the N pole and a reverse surface thereof is the S pole. As for the upstream and downstream development sleeves 8A and 8B, a surface of poles different in polarity from the poles (N2 and N3, S3 and S5) forming the repulsive magnetic fields of the magnet rollers 8A' and 8B' within the upstream and downstream development sleeves 8A and 8B is set to be a surface on the development sleeve side. As a result, a magnetic force line extends between the magnet rollers 8A' and 8B' respectively in the upstream and downstream development sleeves 8A and 8B and the magnets, which are the magnetic seal members 11 and 12. Consequently, a magnetic ear is formed of the developer and leak of the developer is prevented.

Figure 8:
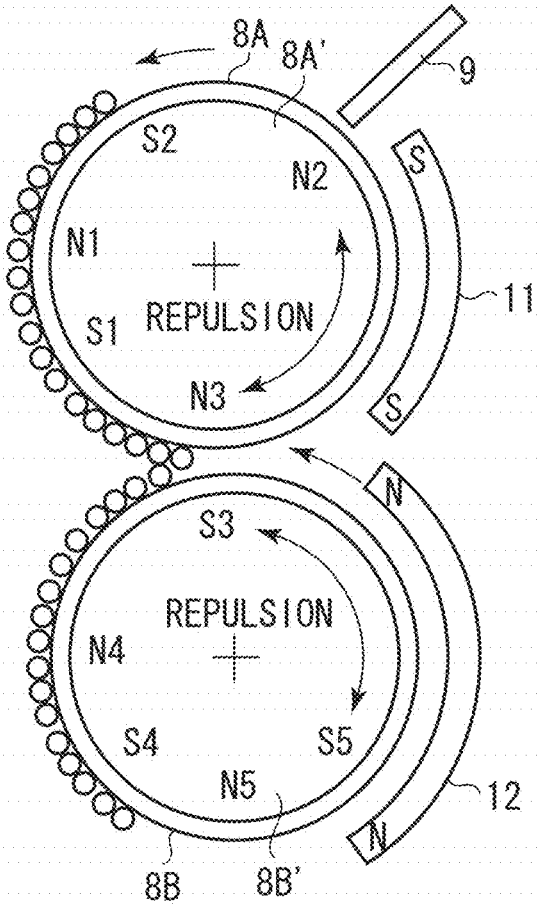
FIG. 8 PRIOR ART
FIG. 8 is a diagram illustrating a configuration of a conventional example as compared with the configuration according to the present invention.

Although described in "Description of the Related Art" as well, however, the prevention of developer leak in the end portion direction of the upstream and downstream development sleeves becomes favorable, whereas the developer is apt to leak from between the upstream development sleeve and the downstream development sleeve as illustrated in the conventional example (FIG. 8). This is caused by the following reason.

The S3 pole in the S3 pole and the S5 pole, which form the repulsive magnetic field in the downstream development sleeve 8B, is also the reception pole, which receives the developer from the upstream development sleeve 8A. As a result, the magnetic seal member does not face the reception pole S3 pole. However, the magnetic seal member and the reception pole S3 pole are opposite poles. A magnetic force line is formed between the magnetic seal member 12 and the reception pole S3. Depending upon the magnet pattern in a portion facing the magnetic seal member 12, therefore, a portion of the developer trapped by the magnetic seal member 12 is attracted to the downstream development sleeve 8B. The attracted developer is conveyed by the rotation of the downstream development sleeve 8B. As a result, the developer leaks out from between the upstream and downstream development sleeves 8A and 8B.

Figure 4:
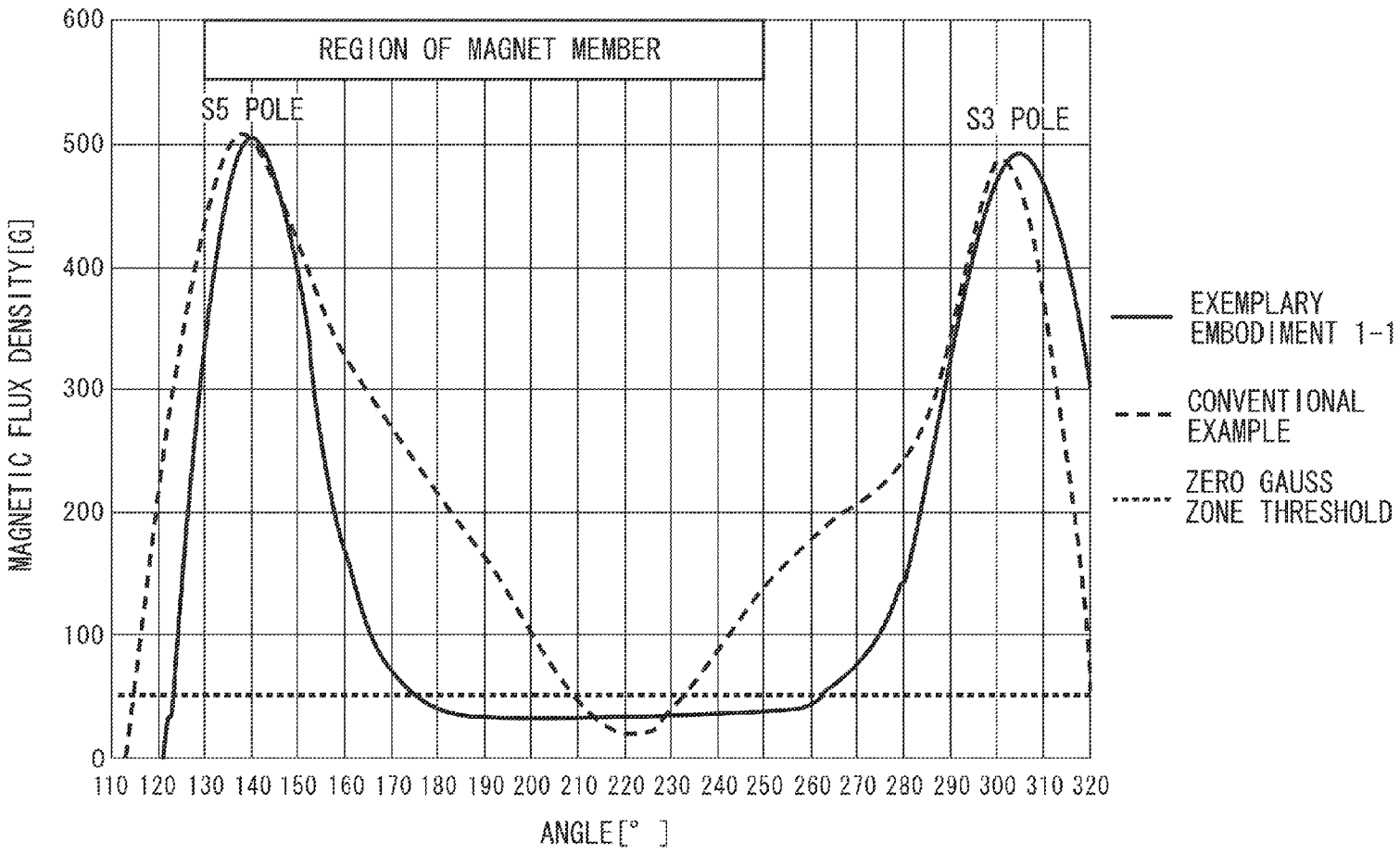
FIG. 4 is a diagram illustrating magnet patterns in an exemplary embodiment 1-1 according to the present invention and a conventional example.

FIG. 4 illustrates magnet patterns of the repulsive poles in the magnet roller 8B' in the downstream development sleeve according to the present exemplary embodiment and the conventional example. As for the angle on the abscissa axis, the horizontal plane is set to be 0 degree and an angle in the clockwise direction is set to be positive. First, a case of the conventional example will now be described. In the conventional example, the zero Gauss zone formed by the repulsive poles is in the range of 210 to 230 degrees in angle. The width 20 degrees is approximately 10% as compared with an angle between the repulsive poles S3 and S5 (140 degrees to 300 degrees=approximately 160 degrees). In the present invention, the zero Gauss zone refers to a region where the magnetic flux density becomes 50 Gauss or less.

On the other hand, in the present exemplary embodiment, the ratio of the zero Gauss zone relative to the region between the repulsive poles is made larger as compared with the conventional example. Specifically, in the present exemplary embodiment, the zero Gauss zone has a width of 90 degrees (=approximately 170 to approximately 260 degrees) whereas the angle between the repulsive poles is approximately 160 degrees (=approximately 140 to approximately 300 degrees). The ratio occupied by the zero Gauss zone in an inter-peak region sandwiched between peak positions where the magnetic flux density of the repulsive pole becomes a peak is approximately 56%.

The present exemplary embodiment is configured such that the zero Gauss zone covered by the second magnet member becomes at least 30% as compared with the inter-peak region of the repulsive poles.

The region of the zero Gauss zone sealed (covered) by the magnetic seal member 12 can be ensured sufficiently by making the ratio occupied by the zero Gauss zone in the angle between the repulsive poles large in this way. In addition, the position that a downstream end of the magnetic seal member 12 faces can be made the zero Gauss zone. Here, adjustment of the magnet pattern can be conducted by, for example, adjusting orientation of magnetic flux density vectors of the repulsive poles. Furthermore, the zero Gauss band can be adjusted in an increasing direction by magnetizing the region between the repulsive poles in different pole directions. Without being restricted to this, the magnet pattern can be adjusted according to a known method.

It is necessary to make the zero Gauss zone formed in the inter-peak region of the repulsive poles larger than the zero Gauss zone covered by the second magnet member in the inter-peak region of the repulsive poles. Therefore, it is desirable that the zero Gauss zone formed in the inter-peak region of the repulsive poles is at least 40%. It is more desirable that the zero Gauss zone formed in the inter-peak region of the repulsive poles is at least 50%.

The magnetic seal member 12 has an N pole as a surface magnetic pole, which is different in polarity from the S3 pole and the S5 pole. The magnetic seal member 12 covers an angle region of 130° to 250°. It is desirable that the magnetic seal member 12 generally covers at least 50% of the repulsive poles S3 pole and the S5 pole in order to prevent the developer from leaking in the end portion direction. It is more desirable that the magnetic seal member 12 covers at least 60% of the repulsive poles S3 pole and the S5 pole. The magnetic seal member 12 has a magnetic flux density of 650 Gauss, and the gap between the magnetic seal member 12 and the downstream development sleeve 8B is set to be 0.6 mm. A feature of the present exemplary embodiment is that the position where the magnetic seal member 12 faces the downstream end is included in the zero Gauss zone formed by the repulsive poles of the magnet roller 8B'. It is desirable that the polarity in the zero Gauss zone formed by the S3 pole and the S5 pole is the same as that of the repulsive poles. On the other hand, if it is attempted to ensure a sufficient magnetic seal region as regards the sleeve peripheral direction in the conventional example, the position where the magnetic seal member 12 faces the downstream end is not in the zero Gauss zone. Therefore, the developer prevented from leaking in the end portion direction by the magnetic seal member 12 and supplemented is attracted by the magnetic flux density between the repulsive poles, and conveyed at a constant ratio by the rotation of the downstream development sleeve 8B to leak out.

Table 1 shows a study result concerning the leak of the developer from between the sleeves. As for the study method, an idle rotation test of the development unit is conducted, and the quantity of the developer that leaks out from between the sleeves in the end portion for one minute is quantified. In the conventional example, the quantity is 0.050 g/min. In the exemplary embodiment 1-1, the quantity decreases to 0.005 g/min. It is considered that the quantity is improved because in the exemplary embodiment 1-1 the developer trapped near the downstream end of the magnetic seal member 12 is not attracted magnetically to the downstream development sleeve 8B. On the other hand, in the conventional example, the leak of the developer from between the sleeves increases because the developer trapped near the downstream end of the magnetic seal member 12 is attracted magnetically to the downstream development sleeve 8B. Especially in a state in which in addition to the leak of the developer from the end portion direction, the developer is supplied from the peripheral direction as well to the magnetic seal member 12, the leak becomes remarkable.

Figure 5:
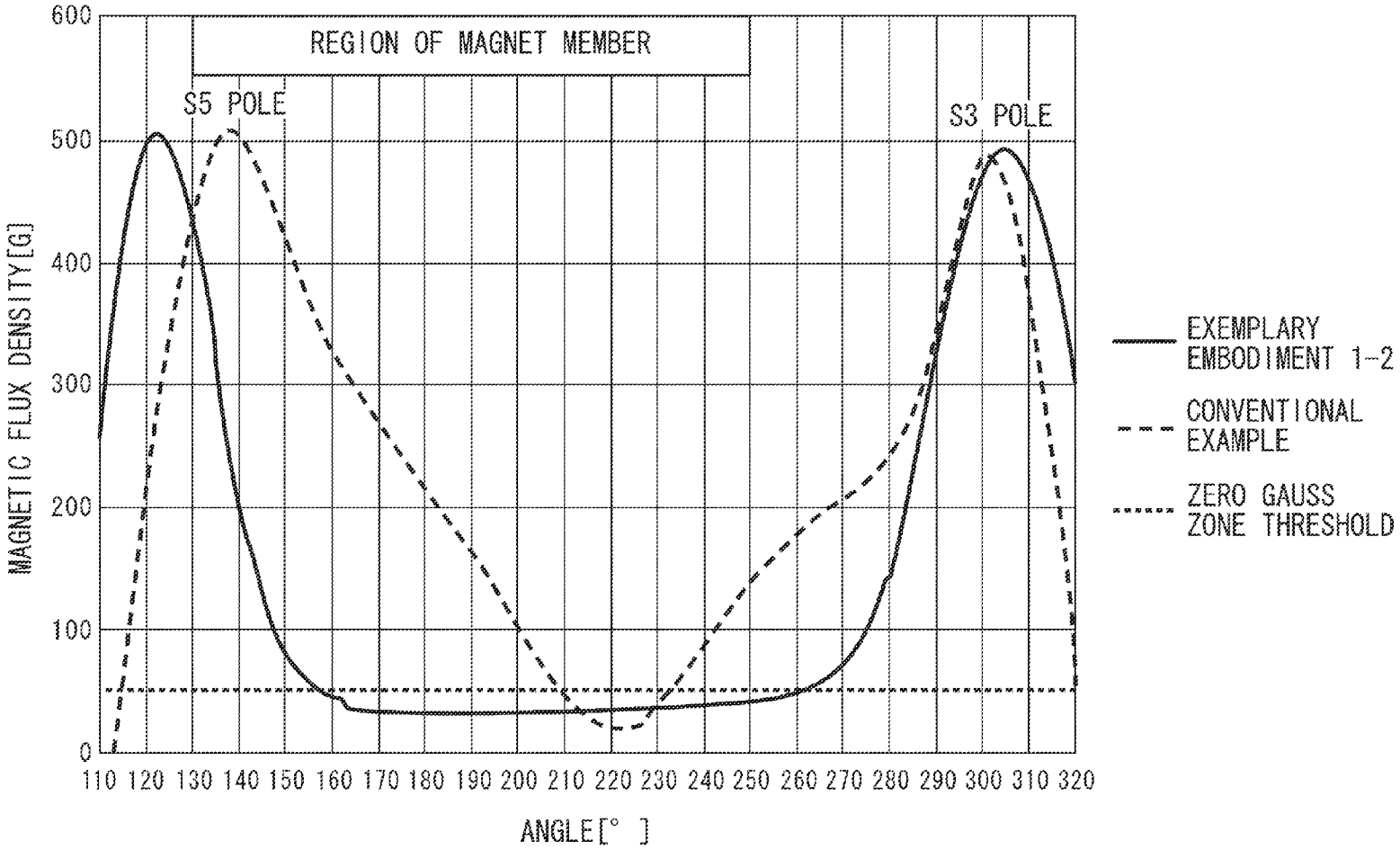
FIG. 5 is a diagram illustrating magnet patterns in an exemplary embodiment 1-2 according to the present invention and a conventional example.

In the exemplary embodiment 1-2, therefore, a magnet roller in which the pole position of the S5 pole (the peak position of the magnetic flux density) is disposed on a further upstream side as compared with the upstream end of the magnetic seal member 12 is used as illustrated in FIG. 5. In other words, the upstream end of the magnetic seal member 12 is configured to become downstream as compared with the pole position of the S5 pole as regards the rotation direction of the second developer bearing member. As a result, in the exemplary embodiment 1-2, the developer leak can be further decreased as compared with the exemplary embodiment 1-1. This is because the magnetic force Fθ in the peripheral direction acts in the development sleeve rotation direction on the upstream side of the peak position of the S5 pole. The developer is conveyed magnetically by the development sleeve. Therefore, it is possible to prevent the developer from entering in the peripheral direction by disposing the peak position of the S5 pole on the upstream side as compared with the upstream end of the magnetic seal member 12. On the downstream side as compared with the peak position of the S5 pole, Fθ acts as magnetic force in reverse to the sleeve rotation direction. Therefore, it is desirable that the peak position of the S5 pole is located on the upstream as compared with a position facing the upstream end of the magnetic seal member 12. However, it is necessary to dispose the upstream end of the magnetic seal member 12 on the upstream side as compared with the zero Gauss zone. In the present exemplary embodiment, the upstream end of the magnetic seal member 12 is disposed in a half value width, which is a region where the magnetic flux density of the S5 pole becomes half of the peak.

The magnetic flux density B and the magnetic force F formed on the development sleeve surface by the magnet roller are defined as follows.

Polar coordinates around the development sleeve are taken into consideration. In the case of representing the radius of the development sleeve as r and an angle of an arbitrary point on a peripheral surface of the development sleeve 8 as θ, a magnetic flux density B at the arbitrary point (r, θ) is represented as B(Br, Bθ). In other words, Br is a component of the magnetic flux density in the sleeve radius direction, and Bθ is a component of the magnetic flux density in the sleeve peripheral direction. In the same way, magnetic force F is magnetic force acting on the carrier at an arbitrary point (r, θ), and is represented as F(Fr, Fθ).

A magnetic force acting the magnetic carrier is given by the following expression.

$$\overline{F}=(Fr,F\theta)$$

$$\overline{F} = \frac{\mu-\mu_0}{\mu_0(\mu+2\mu_0)}2\pi b^3\nabla B^2$$

$\mu_0$ = magnetic permeability of vacuum $\mu$ = magnetic permeability of magnetic carrier $b$ = radius of magnetic carrier $B$ = magnetic flux density Therefore, $$\overline{F} \propto \nabla B^2 = \frac{\partial}{\partial r}(Br^2+B\theta^2)\overline{e}_r + \frac{1}{r}\frac{\partial}{\partial\theta(B_r^2+B_\theta^2)}\overline{e}_\theta \therefore \qquad \text{Expression (1)}$$

$$\overline{F} \propto \underbrace{\left(B_r\frac{\partial B_r}{\partial r}+B_\theta\frac{\partial B_\theta}{\partial r}\right)\overline{e}_r}_{Fr} + \underbrace{\frac{1}{r}\left(B_r\frac{\partial B_r}{\partial\theta}+B_\theta\frac{\partial B_\theta}{\partial\theta}\right)\overline{e}_\theta}_{F\theta}$$

If Br and Bθ are obtained, therefore, Fr and Fθ can be obtained. The magnetic flux density Br can be measured by using a magnetic field measurement device "MS-9902" (product name) manufactured by F. W. BELL as the instrument. For example, measurement is conducted by setting a distance between a probe, which is a member of the instrument, and a surface of the development sleeve to approximately 100 μm.

Bθ can be obtained as follows. A vector potential $A_z(r, \theta)$ in the measurement position of the magnetic flux density Br is obtained by $$A_z(R, \theta) = \int_0^{\theta} RBr\,d\theta$$

by using the measured magnetic flux density Br. Setting the boundary condition to $A_z(r, \theta)$, $A_z(r, \theta)$ is obtained by solving an equation $$\nabla^2 A_z(r,\theta)=0$$

Bθ can be obtained from $$B_\theta = -\frac{\partial A_z(r, \theta)}{\partial r}$$

Fr and Fθ can be introduced by applying Br and Bθ measured and calculated as described above to the above-described expressions.

Figure 6:
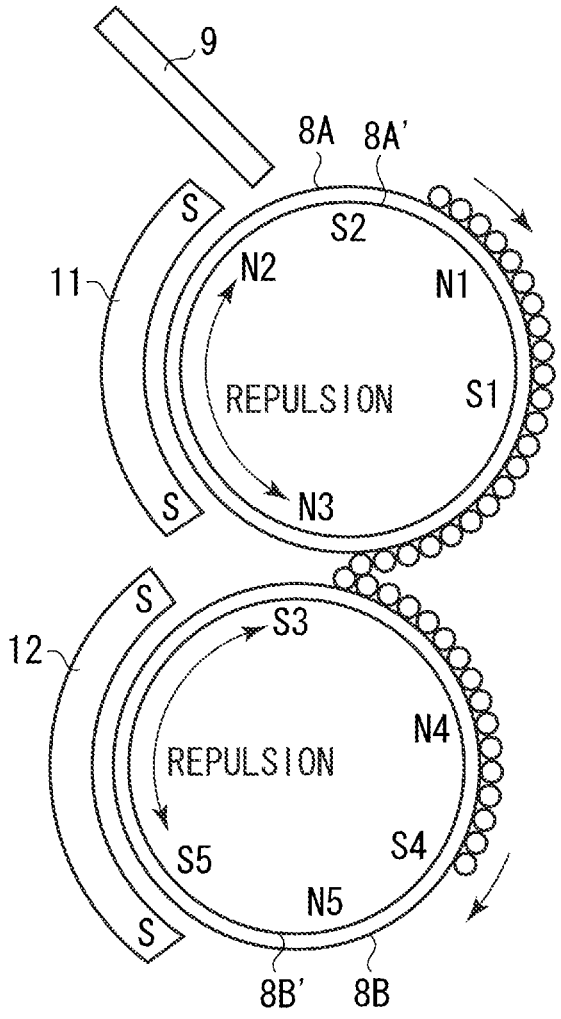
FIG. 6 is a diagram illustrating a configuration of an exemplary embodiment 2 according to the present invention.

As described above, it is possible to suppress the developer leak from between development sleeves in the end portion of the development device including a plurality of development sleeves, even if the surface magnetic pole of the magnetic seal member 12 is made different in polarity from the repulsive poles S3 and S5 on the downstream development sleeve 8B.

the surface magnetic pole of the magnetic seal member 12 is a different pole relative to the S3 pole and the S5 pole on the downstream development sleeve 8B. In the exemplary embodiment 2, however, the surface magnetic pole of the magnetic seal member 12 is made the same polarity as the S3 pole and the S5 pole on the downstream development sleeve 8B as illustrated in FIG. 6.

Figure 7:
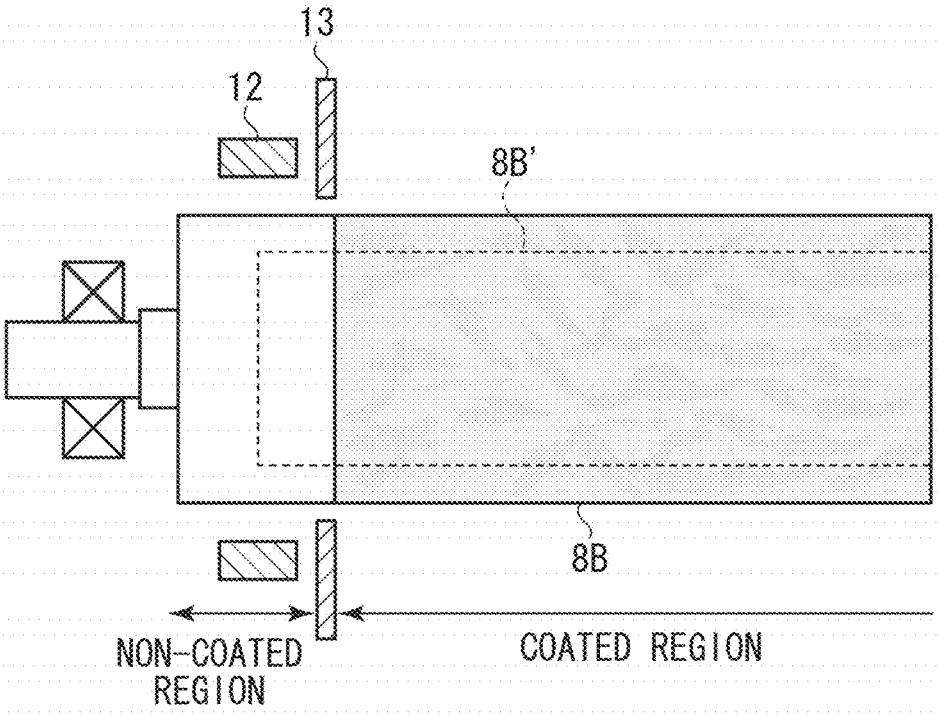
FIG. 7 is a diagram illustrating a position relation between a development sleeve and an incorporated magnet, and a magnetic seal member in the exemplary embodiment 2 according to the present invention.

In the case where the S pole surface, which is the same polarity as the S3 pole and the S5 pole, faces the S3 pole and the S5 pole on the downstream development sleeve 8B, however, a repulsive magnetic field is also formed between the S3 pole and the S5 pole, and the magnetic seal member 12. Therefore, there is a fear concerning a problem of a seal property in the lengthwise direction of the development sleeve. In the case where the surface magnetic pole of the magnetic seal member 12 is made the same polarity as the S3 pole and the S5 pole, therefore, it is desirable to provide a magnetic seal member 13 as a magnetic member in the vicinity of the magnetic seal member 12 inside the container as illustrated in FIG. 7. The magnetic seal member 13 is magnetized by the magnet roller 8B' included in the downstream development sleeve, and the magnetic seal member 12. The magnetic seal member 13 seals magnetically the end portion of the downstream development sleeve 8B in conjunction with the magnetic seal member 12. A gap between the magnetic seal member 13 and the downstream development sleeve 8B is set to 0.6 mm. The magnetic seal member 13 is disposed along the peripheral surface of the downstream development sleeve 8B to locate the upstream end of the magnetic seal member 13 on the upstream side as compared with the S5 pole and locate the downstream end of the magnetic seal member 13 on the downstream side as

TABLE 1

| | S3 pole position | S5 pole position | Downstream end of magnetic seal member and zero Gauss zone | Magnet member and S5 pole position | Magnetic seal member | Magnetic plate | Developer leak [g/min] |
|---|---|---|---|---|---|---|---|
| Exemplary embodiment 1-1 | 306° | 140° | Facing zero Gauss zone | Peaks overlap | Different polarity | Not present | 0.005 |
| Exemplary embodiment 1-2 | 306° | 122° | Facing zero Gauss zone | Peaks do not overlap | Different polarity | Not present | 0.001 |
| Conventional example 1 | 306° | 140° | Not facing zero Gauss zone | Peaks overlap | Different polarity | Not present | 0.050 |

An exemplary embodiment 2 of the present invention will now be described. The basic configuration and operation of an image forming device in the present exemplary embodiment is the same as those in the exemplary embodiment 1. Therefore, an element having the same or equivalent function and configuration is denoted by like reference numeral, and detailed description thereof will be omitted. Feature points in the present exemplary embodiment will be described below.

In the exemplary embodiment 1, the position on the magnetic seal member 12 facing the downstream end in the rotation direction of the downstream development sleeve 8B is included in the zero Gauss zone. In addition, on the upstream end, the peak of the S5 pole is disposed on the upstream as compared with the upstream end. Owing to such a configuration, the developer leak in the development sleeve rotation direction from between the two development sleeves can be suppressed. In the exemplary embodiment 1, compared with the downstream end of the magnetic seal member 12. Specifically, the magnetic seal member 13 covers a range of 90° to 265°. In the present exemplary embodiment, the magnetic seal member 13 is disposed in a position facing the zero Gauss zone. It is desirable to dispose the magnetic seal member 13 as well in a position facing the zero Gauss zone in the same way as the magnetic seal member 12. Since the magnetic seal member 13 is not a magnet unlike the magnetic seal member 12, it is not always necessary that the magnetic seal member 13 faces the zero Gauss zone.

In the above-described configuration, an idle rotation test is conducted in the same way as the exemplary embodiment 1. Results shown in Table 2 are obtained. For the purpose of comparison, results of a second convention example are also shown. According to Table 2, the developer leak from between the development sleeves is 0.026 g/min in the second conventional example. On the other hand, in the exemplary embodiment 2-1, the developer leak from between the development sleeves is 0.000 g/min. A minute value which cannot be measured by an ordinary scale is obtained. This is considered as follows. First, the magnetic seal member 13 is magnetized by the S3 pole or the S5 pole in the development sleeve or the magnetic seal member 12. A magnetic seal formed of the developer is formed between the magnetic seal member 13 and the downstream development sleeve 8B. As a result, developer leak in the end portion direction is suppressed. An effect that supply of the developer from the lengthwise direction to the magnetic seal member 12 becomes hard is obtained. On the other hand, in the case of the second conventional example, the downstream end of the magnetic seal member 12 is provided in a position that is on a more downstream side as compared with the downstream end of the zero Gauss zone. Therefore, the developer constrained by the magnetic seal member 12 is apt to be conveyed by the rotation of the downstream development sleeve 8B and magnetic force of the S3 pole in the development sleeve. In other words, the developer trapped near the downstream end of the magnetic seal member 12 is attracted magnetically to the downstream development sleeve 8B. Consequently, the leak of the developer from between the sleeves increases.

As described above, it is possible to prevent developer leak from between sleeves in the end portion of the development device including a plurality of development sleeves.

In the present exemplary embodiment, the magnetic seal member 12 has the same polarity uniformly on a surface facing the downstream development sleeve 8B. However, the magnetic seal member 12 is not restricted to this. In other words, in the present exemplary embodiment, the surface is made uniformly the same polarity as the S3 pole and the S5 pole on the downstream development sleeve. However, a configuration in which at least an end portion region on the downstream side as regards the second developer bearing member rotation direction is provided with the same polarity as the S3 pole may be adopted.

TABLE 2

| | S3 pole position | S5 pole position | Downstream end of magnetic seal member and zero Gauss zone | Magnet member and S5 pole position | Magnetic seal member | Magnetic plate | Developer leak [g/min] |
|---|---|---|---|---|---|---|---|
| Exemplary embodiment 2-1 | 306° | 122° | Facing zero Gauss zone | Peaks do not overlap | Same polarity | Present | 0.000 |
| Conventional example 2 | 306° | 140° | Not facing zero Gauss zone | Peaks overlap | Same polarity | Present | 0.026 |

According to the present invention, with respect to the development device including a plurality of development sleeves, developer leak in the development sleeve rotation direction from between the two development sleeves can be suppressed while ensuring the magnetic seal property in the development sleeve end portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-196671, filed Sep. 26, 2014, which is hereby incorporated by reference herein in its entirety.

What is claimed is:

1. A development device comprising:

a first developer bearing member configured to bear and convey a developer including magnetic particles and develop an electrostatic latent image;

a second developer bearing member rotatable in a same direction as a rotation direction of the first developer bearing member and configured to bear and convey the developer delivered from the first developer bearing member and develop the electrostatic latent image developed by the first developer bearing member;

a development container configured to expose portions of the first developer bearing member and the second developer bearing member in an opening portion and accommodate the developer;

a first magnetic field generation member configured to be disposed within the first developer bearing member and include a plurality of magnetic poles including at least a first magnetic pole provided to face the second developer bearing member;

a second magnetic field generation member configured to be disposed within the second developer bearing member and include a plurality of magnetic poles including a second magnetic pole and a third magnetic pole, the second magnetic pole being provided to substantially face the first magnetic pole and being different in polarity from the first magnetic pole, the third magnetic pole being same in polarity as the second magnetic pole and being disposed on an upstream side as compared with the second magnetic pole as regards the rotation direction of the second developer bearing member;

a first magnet member provided in an end portion in an axis direction of the first developer bearing member and provided on a side opposite to an image bearing member, of the first developer bearing member, the first magnet member being provided on a downstream side as compared with the first magnetic pole as regards the rotation direction of the first developer bearing member, the first magnet member being disposed along a peripheral surface of the first developer bearing member; and a second magnet member provided in an end portion in an axis direction of the second developer bearing member and provided on a side opposite to the image bearing member, of the second developer bearing member, the second magnet member being provided on an upstream side as compared with the second magnetic pole as regards the rotation direction of the second developer bearing member, the second magnet member being disposed along a peripheral surface of the second developer bearing member, the second magnet member being disposed to face a zero Gauss zone, which becomes 50 Gauss or less in magnetic flux density, formed between the second magnetic pole and the third magnetic pole, wherein as regards the rotation direction of the second developer bearing member, an upstream end of the second magnet member is disposed on an upstream side as compared with an upstream end of the zero Gauss zone, and a downstream end of the second magnet member is disposed on a downstream side as compared with the upstream end of the zero Gauss zone and on an upstream side as compared with a downstream end of the zero Gauss zone.

2. The development device according to claim 1, wherein as regards the rotation direction of the second developer bearing member, the upstream end of the second magnet member is positioned on a downstream side as compared with a peak position of a magnetic flux density of the third magnetic pole.

3. The development device according to claim 1, wherein as regards the rotation direction of the second developer bearing member, a range of the second developer bearing member covered by the second magnet member is at least 50% of an inter-peak region of magnetic flux density of the second magnetic pole and the third magnetic pole.

4. The development device according to claim 1, wherein a surface of the second magnet member facing the second developer bearing member is same in polarity as the second magnetic pole, and wherein the device further comprises a magnetic member provided in the end portion in the axis direction of the second developer bearing member to face the second magnet member, disposed along the peripheral surface of the second developer bearing member, and magnetized by the second magnetic field generation member.

5. The development device according to claim 4, wherein the magnetic member is disposed along the peripheral surface of the second developer bearing member, as regards the rotation direction of the second developer bearing member, an upstream end of the magnetic member is positioned on an upstream side as compared with a peak position of a magnetic flux density of the third magnetic pole, and a downstream end of the magnetic member is positioned on a downstream side as compared with the downstream end of the second magnet member.

6. The development device according to claim 1, wherein between the second magnetic pole and the third magnetic pole, as regards a peripheral direction of the second developer bearing member, a ratio of a region where the second magnet member and the zero Gauss zone overlap is at least 30%.

* * * * *